US009706884B2

(12) United States Patent
Arkwright

(10) Patent No.: US 9,706,884 B2
(45) Date of Patent: Jul. 18, 2017

(54) DISPOSABLE BATH BRUSH WITH INTEGRAL GEL SOAP AND MOISTURIZER DISPENSERS

(71) Applicant: Linda Melissa Arkwright, Atlanta, GA (US)

(72) Inventor: Linda Melissa Arkwright, Atlanta, GA (US)

( * ) Notice: Subject to any disclaimer, the term of this patent is extended or adjusted under 35 U.S.C. 154(b) by 170 days.

(21) Appl. No.: 14/641,344

(22) Filed: Mar. 7, 2015

(65) Prior Publication Data

US 2015/0173570 A1 Jun. 25, 2015

Related U.S. Application Data

(63) Continuation-in-part of application No. 13/277,631, filed on Oct. 20, 2011, now abandoned.

(51) Int. Cl.

| | |
|---|---|
| ***A47K 7/03*** | (2006.01) |
| ***A46B 5/00*** | (2006.01) |
| ***A46B 11/00*** | (2006.01) |

(52) U.S. Cl.

CPC ..... *A47K 7/03* (2013.01); *A46B 5/005* (2013.01); *A46B 11/002* (2013.01); *A46B 2200/01* (2013.01); *A46B 2200/10* (2013.01)

(58) Field of Classification Search

CPC ..... A46B 5/0033; A46B 5/0041; A46B 5/005; A46B 5/0054; A46B 5/0075; A46B 5/0079; A46B 5/0083; A46B 11/0003; A46B 2200/1003; A47K 7/022; A47K 7/028; A47K 7/03

USPC ..... 15/143.1, 144.1; 16/429

See application file for complete search history.

(56) References Cited

U.S. PATENT DOCUMENTS

| | | | | |
|---|---|---|---|---|
| 1,452,976 | A * | 4/1923 | Lichtenstein | A47K 7/028 401/286 |
| 2,641,012 | A * | 6/1953 | Storrs | B25G 1/04 15/144.4 |
| 4,184,221 | A | 1/1980 | Edwards | |
| 4,899,417 | A * | 2/1990 | Schaffer | B05C 17/0205 15/143.1 |
| 5,528,792 | A | 6/1996 | Nazemi | |
| 5,664,281 | A * | 9/1997 | Pelfrey | A45D 34/04 15/144.1 |
| D394,328 | S * | 5/1998 | Palumbo | D28/7 |
| 5,769,802 | A | 6/1998 | Wang | |
| 6,195,829 | B1 | 3/2001 | Chen | |
| 6,256,829 | B1 * | 7/2001 | Hatch | A46B 5/0033 15/144.1 |

(Continued)

*Primary Examiner* — Jennifer C Chiang
*Assistant Examiner* — Bradley Oliver
(74) *Attorney, Agent, or Firm* — J.T. Hollin, Attorney at Law, P.C.

(57) ABSTRACT

The present invention is a disposable bath brush intended for one or possibly two uses in the shower or bath. The bath brush contains soap gel and moisturizer stored in containers within the brush. Either of these fluids may be dispensed by applying pressure to the individual container or an integral release button, thereby causing the respective fluid to flow out of an opening at the front center of the brush. Also included is a retractable handle to provide a user with an extended gripping surface for reaching the back of the body and the feet. The front of the brush comprises bristles of any of a variety of materials and of an adequate length to provide a thorough cleansing experience.

2 Claims, 5 Drawing Sheets

(56) References Cited

U.S. PATENT DOCUMENTS

| | | | | |
|---|---|---|---|---|
| 6,581,219 | B1 | 6/2003 | Powaska | |
| 6,629,799 | B2 * | 10/2003 | Flores, Jr. | A47K 5/1202 15/104.92 |
| 6,735,808 | B2 | 5/2004 | Chen | |
| 7,178,192 | B2 | 2/2007 | Huang | |
| 2003/0165351 | A1 * | 9/2003 | Tatapudy | A46B 11/0041 401/270 |
| 2010/0275415 | A1 * | 11/2010 | Gonzales | A45C 13/262 16/429 |

* cited by examiner

DISPOSABLE BATH BRUSH WITH INTEGRAL GEL SOAP AND MOISTURIZER DISPENSERS

REFERENCE TO RELATED APPLICATION

This application claims all accrued benefits deriving from non-provisional application Ser. No. 13/065,064, confirmation #4955, including Claims 1 through 8 of that application.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION (1) Field of the Invention

The inventive concept presented herein generally is concerned with devices and methods utilized for quick, efficient, and convenient personal hygiene, particularly with relation to bathing and showering. Disclosed is a disposable shower or bath brush having internally separate compartments containing liquid soap and a liquid moisturizer.

Bathing for humans has for thousands of years been a generally pleasant experience. It is also a necessary procedure for maintenance of clean skin and riddance of infectious conditions or exfoliation of deteriorating epidermis.

Individuals who travel frequently, and stay in hotels, may oftentimes prefer scented soap gels and skin moisturizers used in conjunction with a bath brush as compared to using the hotel's soap, which could dry the skin and/or wash cloths that may not be at the highest level of cleanliness in some establishments. After rinsing and applying the skin moisturizer, the skin should be left feeling soft and silky. The inventive concept disclosed herein is designed for travel. It will eliminate the clutter of packing a bottle of shower gel, a shower brush or loofah sponge, and possibly shower moisturizers.

There are any versions of bath sponges or shower brushes with handles which are used to enhance the showering experience. Unfortunately, many of those items are convenient to pack and take along on business trips or family vacations because of the long handles. For consumers that frequently travel on airplanes, the disclosed inventive concept, commercially known as the "Quick Freshe" pack, will eliminate the need to transfer shower gel into 3-ounce bottles in compliance with the Federal Aviation Agency's regulations for carry-on luggage. The disclosed device will also eliminate frustrating attempts to pack long-handled back scrubbers and shower brushes into their luggage. Because the "Quick Freshe" is a sanitary, prepackaged, full service shower supply, it will be ideal to send with children and teens for sleepovers or summer camps.

During the first days on a new college campus, there may not be time for laundry duties. A few packages of "Quick Freshe" will eliminate the need for re-using wash cloths, which hold bacteria and germs, especially until a regular laundry schedule can be set up. Another effective use of the disposable shower brush is in situations similar to the emergency evacuations that resulted from the aftermath of hurricane Katrina. As thousands of persons were being displaced, distribution of a disposable shower brush would have been a comfort and hygienic relief to countless persons involved in such a tragedy.

(2) Description of the Related Art

In the field of shower or bath brushes, a number of unique developments and products have been manifested in the past; some complicated or intricate, and many, very basic. Several of them, which are relevant to this inventive concept, are listed as follows:

U.S. Pat. No. 4,184,221; (Edwards, E., Jan. 22, 1980). The invention is a bath brush having an elongated, continuously curved device with a handle at one end and a brush at the other end. The brush arrangement includes an enlarged head with bristles and further, having a pair of clips on either side of the arrangement of bristles for removably holding a face cloth, there by facilitating bathing with the brush and face cloth.

U.S. Pat. No. 5,528,792; (Nazemi, A. Jun. 25, 1996). Disclosed is a shower brush with a handle at one end and a group of bristles located upon one face at the other end. The device has an axial pivot medial to two ninety degree bends taken with respect to the longitudinal axis of the shank. U-shaped and an S-shaped configuration are thus enabled, each being obtained from the other by rotation of one shank portion relative to the other through one hundred eighty degrees in either direction about the axial pivot.

U.S. Pat. No. 5,769,802 (Wang, Jun. 23, 1998). Disclosed is a device having a grouping of circular brushes which are arranged on a platform. The platform contains tubing to allow water from the shower head power a rotational mechanism inside each brush and also gently force liquid soap toward the vicinity of the brush bristles.

U.S. Pat. No. 6,195,829 (Chen, C. Mar. 6, 2001). The invention comprises a bath brush including an elastic mesh tube-like structure which is axially pushed and gathered so as to continuously crimp the perimeter of the tube into a waved pattern; a handle connected to a framework and grip mechanism which are freely detachably assembled with a connecting member, and a pair of massaging spheres positioned on the upper side of the elastic mesh tube.

U.S. Pat. No. 6,581,219 (Powaska, T., Jun. 24, 2003). The inventor designed a rotary shower brush of primarily elongated shape for mounting vertically in a shower stall, comprising a brush assembly, a motor assembly, upper and lower mount assemblies. The motor assembly is operatively connected to, and rotates the brush assembly. One embodiment also provides that the brush assembly oscillates up and down as it rotates.

U.S. Pat. No. 6,735,808 (Chen, K., May 18, 2004). Disclosed is a bath brush comprising a main body, a massaging member, and a bristle holder connected to a top of the massaging member. The bristle holder is provided with a plurality of insertion holes for implanting tufted bristles therein and a plurality of through-holes for massaging projections integrally formed on the massaging member to upwardly extend therethrough and expose from the bristle holder.

U.S. Pat. No. 7,178,192 (Huang, M., Feb. 20, 2007). The invented device is a bath brush having a holding frame, a thread girdle, and a tube-shaped elastic net. The holding frame has a corrugated handle portion having an end hole, and a binding portion having a plurality of protruded blocks, each of which has a through-aperture. The protruded blocks contact the tube-shaped elastic net. The thread girdle surrounds the tube-shaped elastic net to squeeze and to bind the tube-shaped elastic net.

BRIEF SUMMARY OF THE INVENTIVE CONCEPT

The "Quick Freshe" bath brush is an inventive concept designed to provide a convenient, sanitary showering product for individuals who travel frequently, families at campsites, children at summer camps, college students, truck drivers, and traveling sales persons. The device disclosed herein is a shower/bath brush having the convenience of internally-generated shower and moisturizing gels. Also featured is a retractable handle for easier portability, and a hand strap for secure grasping of the brush when in use. The device is designed to be disposable after two to three uses and thereby enhances an overall sanitary bath or shower experience for the consumer.

The brush has a cloth hand strap across the back surface to help keep it secured within the grasp of the user's hand as the brush is maneuvered to gently scrub the body. A handle with gripping ridges is built onto a swivel joint and is normally stored in a compartment within the brush. The handle may be released and unfolded from the side of the brush, then locked into a straight-line position to provide extended reach for scrubbing the back or feet.

BRIEF DESCRIPTION OF THE VIEWS OF THE DRAWINGS

The objects, features, and advantages of the concept presented in this application are more readily understood when referring to the accompanying drawings. The drawings, totaling eight figures, show the basic functions of the preferred embodiment of the inventive concept.

FIG. 1(*a*) is a detached view of the brush handle and first clip, as would be seen in looking toward the back surface of the brush.

FIG. 1(*b*) is a standalone view of the first clip, as seen looking downward from the top end of the brush handle.

FIG. 4(*a*) illustrates a three-dimensional view of the second clip utilized for affixing the brush handle when it is retracted within the compartment.

DETAILED DESCRIPTION OF THE INVENTIVE CONCEPT

For the sake of illustrative purposes only, the following discussion and summary will be directed to a preferred embodiment of the inventive concept. The inventive concept herein may be manufactured with a variety of brush 1/handle 7 combinations and differing means of storing the handle 7 in an interior compartment 13 of the brush 1 when not in use. The disclosure also features different and effective means of storing and dispensing soap gel and moisturizer fluids within the brush 1. The general description of the device will proceed from an overall vie of FIG. 1.

Figures 1, 1A, 1B:
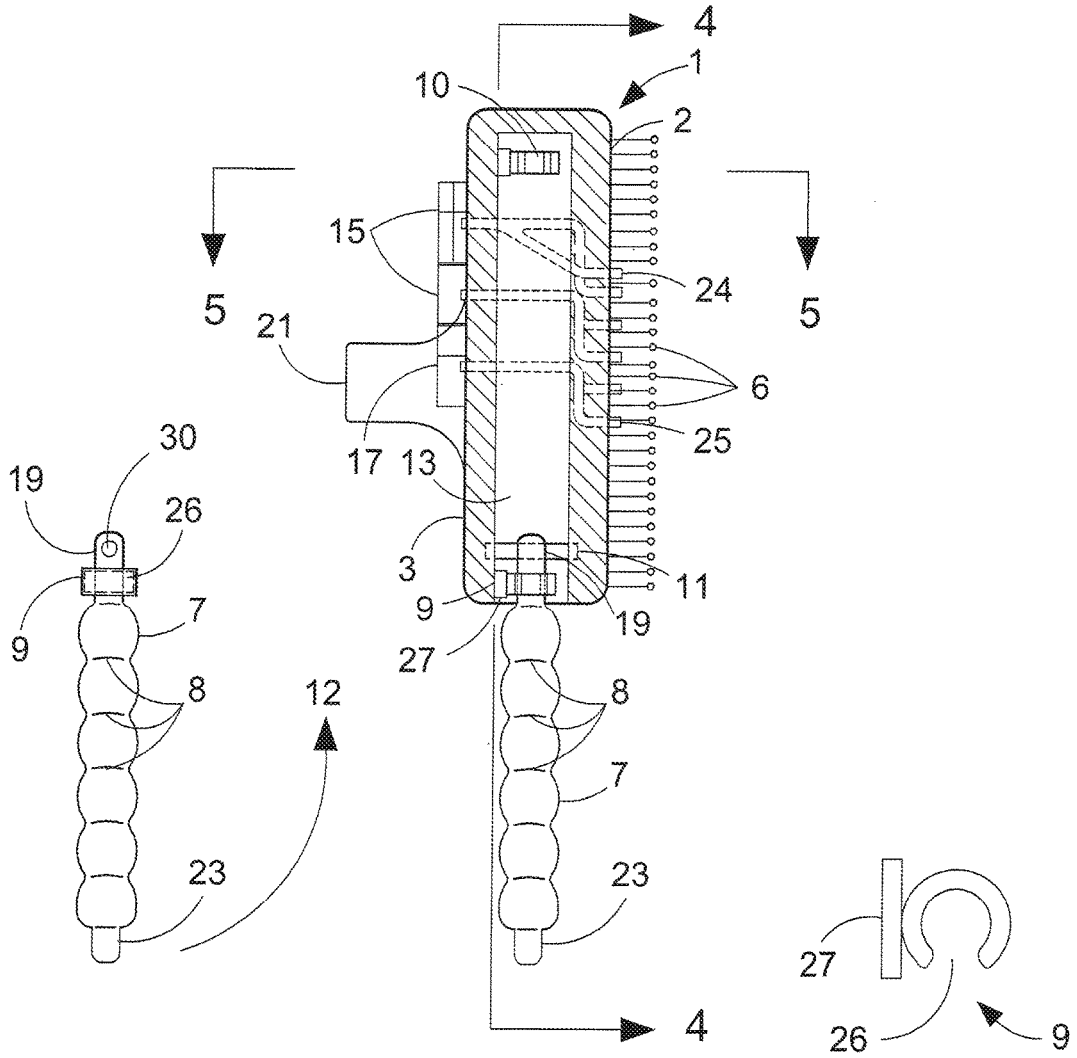
FIG. 1 presents a left side view of the brush, with the interior storage compartment visible; also showing the bristles as imbedded in the front surface of the brush, a hand strap, and the handle in the extended position.

In viewing FIG. 1, there is presented a left side view of a bath/shower brush 1 having its handle 7 extended in a downward position, which is the position in which a user may effectively use the brush 1 while showering. FIG. 1 and FIG. 1(*a*) both show that the handle 7 is comprised of an upper hilt 19 and a lower retainer stub 23 which are constructed at the upper and lower end, respectively, of the handle 7. The handle 7 is also composed of gripping ridges 8 which assist a user in grasping the handle 7 during showering. FIG. 1(*b*) illustrates a standalone view of the first clip 9, as seen looking downward from the top end of the brush 1 as the first clip 9 is oriented in its actual attachment to the inner side of the back surface 3 of the brush 1.

The inner side of the back surface 3 of the brush 1 also forms the rear inner compartment wall 14 of the brush 1. Also shown in FIG. 1(*b*) is the circular opening 26, and the base 27 of the first clip 9, which base 27 is attached to the rear inner compartment wall 14 of the compartment 13 within the brush 1. The first clip 9 is formed of a semi-rigid material with some degree of flexion. The circular opening 26 of an inner diameter that s approximately equal to the outer diameter of the hilt 19 of the brush handle 7. The circular opening 26 is flexible enough to allow the hilt 19 to be inserted into the first clip 9 and securely retained in the downward, extended position. The compartment 13 exists between the back surface 3 and the front surface 2 of the brush 1. FIG. 1 shows the base 27 of the first clip 9 in its orientation to the hilt 19 of the handle 7.

FIG. 1(*a*) is a detached view of the rear of the handle 7, further showing the location and orientation of the first clip 9 relative to the hilt 19 of the handle 7. The hilt 19 further is constructed with a circular pin slot 30. The pin slot 30 is of a diameter corresponding to the outer diameter of a pin 11, shown in FIG. 1. The pin 11 is attached to the lower inner surfaces of the compartment 13. The pin 11 serves to provide an axis of rotation for the hilt 19 of the handle 7 in a closing travel direction 12 moving the handle 7 from its extended position to a configuration of storage within the compartment 13. Once the handle 7 is rotated into the compartment 13, a lower retainer stub 23, shown at the lower end of the handle 7 will come into contact with a second clip 10 which is of identical construction and dimensions as the previously-mentioned first clip 9. The second clip 10 is attached interiorly to the upper part of the inner surface of the compartment 13 and is affixed so that the opening of the second clip 10 corresponds to the linear axis of the handle 7. The user then will press the handle 7, and specifically the retainer stub 23 into the second clip 10, thereby providing storage of the handle 7 within the compartment 13.

When a user desires to use the brush 1 he/she would dislodge the retainer stub 23 from the second clip 10 and move the handle 7 downward in a travel direction opposite of the closing travel direction 12, ebase 27 of the first clip 9 and a through-hole, or pin slot 30 drilled through the upper end of the hilt 19. The pin slot 30 is of a size to accommodate a linear pin 11, which is affixed orthogonally to both the back surface 3 and the front surface 2 of the brush 1. The pin 11 thereby allows the hilt 19 of the handle 7 to be rotated about the axis of the pin 11 by means of the pin slot 30. A user rotates the handle 7 in the direction of travel 12 (as shown in FIG. 1(*a*)) towards the compartment 13 of the brush 1.

The compartment 13 is of a size to accommodate the handle 7 when the handle 7 is stored.

Prominently shown in FIG. 1 is the arrangement of bristles 6 imbedded within the front surface 2 of the brush 1. The handle 7 is displayed in the extended position, having been rotated outward from its storage area within the compartment 13. In the extended position, the handle 7 permits a user to more easily reach body areas such as the feet, legs, and back during showering. The handle 7 further comprises gripping ridges 8 for a more convenient and secure fit within a user's hand. Also shown in FIG. 1 is a partial view of a hand strap 21 which is attached to the back surface 3 of the brush 1. The hand strap 21 may be grasped by a user in addition to, or instead of the handle 7 as the brush 1 is maneuvered, so as to gently scrub or massage the skin during bathing. The handle 7 may also comprise a retainer ring or flexible looped material for hanging the handle 7 of the brush 1 on a typical bathroom wall or door hook.

Figure 2:
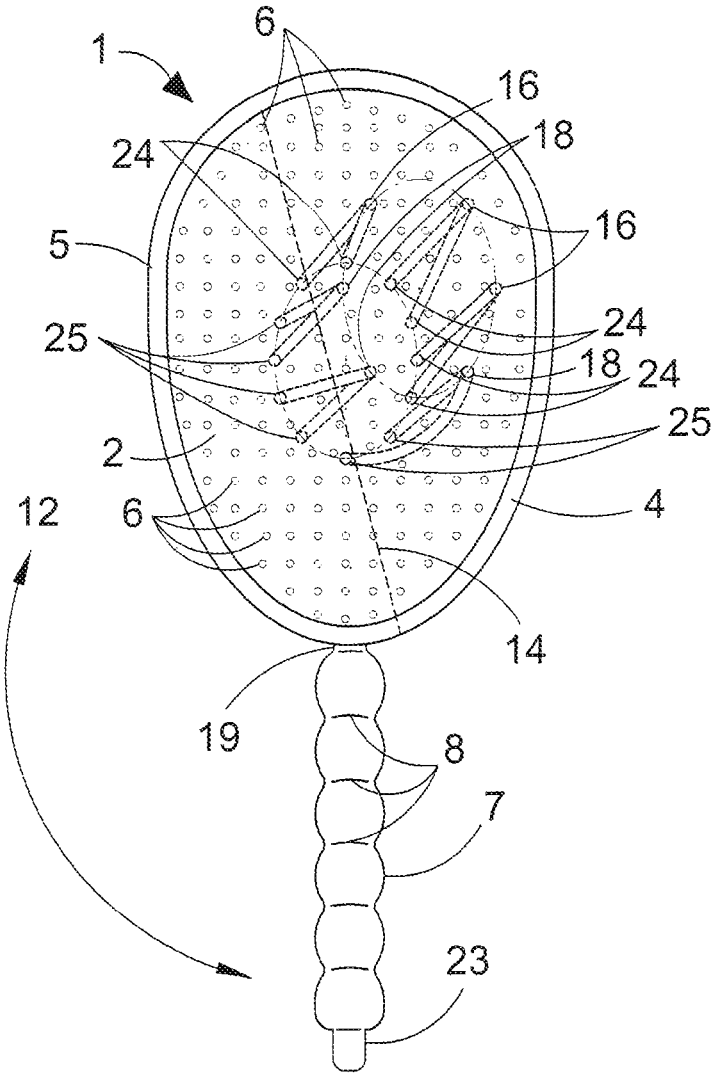
FIG. 2 presents a frontal view of the brush, displaying the array of bristles imbedded on the front surface, a hidden view of the dispenser ports for soap gel/or moisturizer, and the handle in the extended position.

In viewing FIG. 2, there is depicted the front face 2 of the brush 1, along with the imbedded bristles 6, the soap gel dispensing ports 24, and the moisturizer dispensing ports 25. The handle 7 is in the extended position and also to be noted are the gripping ridges 8 on the handle 7. In using the cleansing accessories to the brush 1, a user exerts finger pressure onto one or more of the soap gel storage packs 15 (refer to FIG. 3) or any one or more of the moisturizer storage packs 17 (refer to FIG. 3) to induce a flow of the respective liquids through the associated dispensing ports 24, 25 and onto the general area of the bristles 6. The bristles 6, in the preferred embodiment, are comprised of nylon, however any other suitable material may be used, including plastic or other artificial substance which can provide a firm, but comfortable pressure to the skin of the user. The bristles 6 imbedded in the front surface 2 are preferably of medium-firm texture.

By way of an approximate recital of the dimensions of the device, the shower brush 1 front face 2 is optimally in the range of six inches to eight inches in length, top to bottom, three to four inches from side-to-side, and one to two inches in depth from the back surface 3 to the tips of the bristles 6. The handle 7 would measure between five to seven inches in length. As explained previously, in a preferred embodiment, when the handle 7 is not in use, it may be rotated in a counter-clockwise direction of travel 12, shown in FIG. 2, into the compartment 13, which is hidden from view.

In another embodiment of the brush 1, the handle 7 can be fixed to the brush 1 by two permanent fasteners on either side of the brush 1, which allows a back and forth movement of the brush 1 by pushing the handle 7 in the desired direction.

Figure 3:
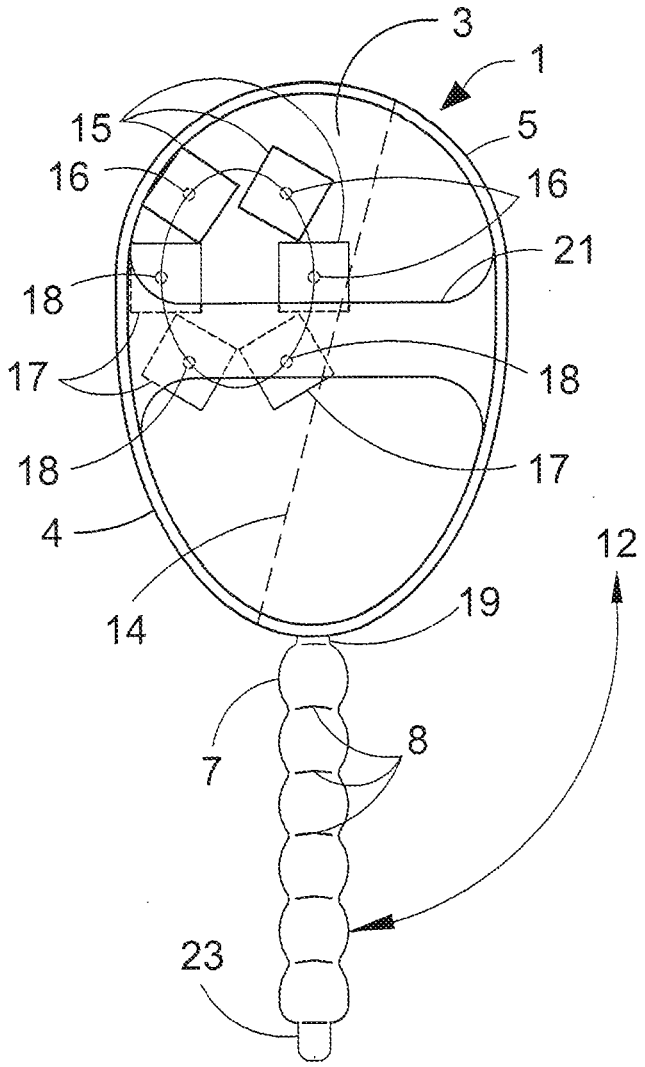
FIG. 3 illustrates a cutaway view of the back of the brush, as seen from section line 4-4 of FIG. 1, and further showing the soap gel container packets, and moisturizer container packets.

In turning to FIG. 3, the back surface 3 of the brush 1 is presented, wherein the hand strap 21 is shown in its orientation of being attached width-wise across the back surface 3 of the brush from the right side 5 (as seen from the "bristle side" of the brush 1 to the left side 4. A series of gel storage packs 15 and moisturizer storage packs 17 are shown on the back surface 3 of the brush 1. A dashed line represents the compartment wall 14, which is the limit of the compartment 13 of the brush 1.

All storage packs 15, 17, are permanently attached to the back surface 3 of the brush 1. The storage packs 15, 16, may be of a relatively thin, compressible material which can be easily depressed with slight finger pressure from the user. A different embodiment of the shower brush 1 may feature compressed air that may be generated by a push-button type arrangement into the storage packs 15, 17.

Gel flow tubes, or passageways 16, and moisturizer flow tubes or passageways 18, are an integrally-constructed part of each of the storage packs 15, 16. The flow tubes 16, 18 are bent at a short distance from their connection with their respective packs 15, 17, and directed into apertures 22 on the back surface 3 of the brush 1. The flow tubes 16, 17, then connect to the respective dispensing ports 24, 25 on the front surface 2 of the brush 1.

Figure 4A:
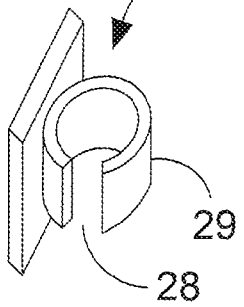
FIG. 4 is a partial cutaway view of the brush as seen from section line 4-4 of FIG. 1; further illustrating the gel and moisturizer passageways, or tubes, and also a stylized view of the brush handle stowed in its compartment.
Figure 4:
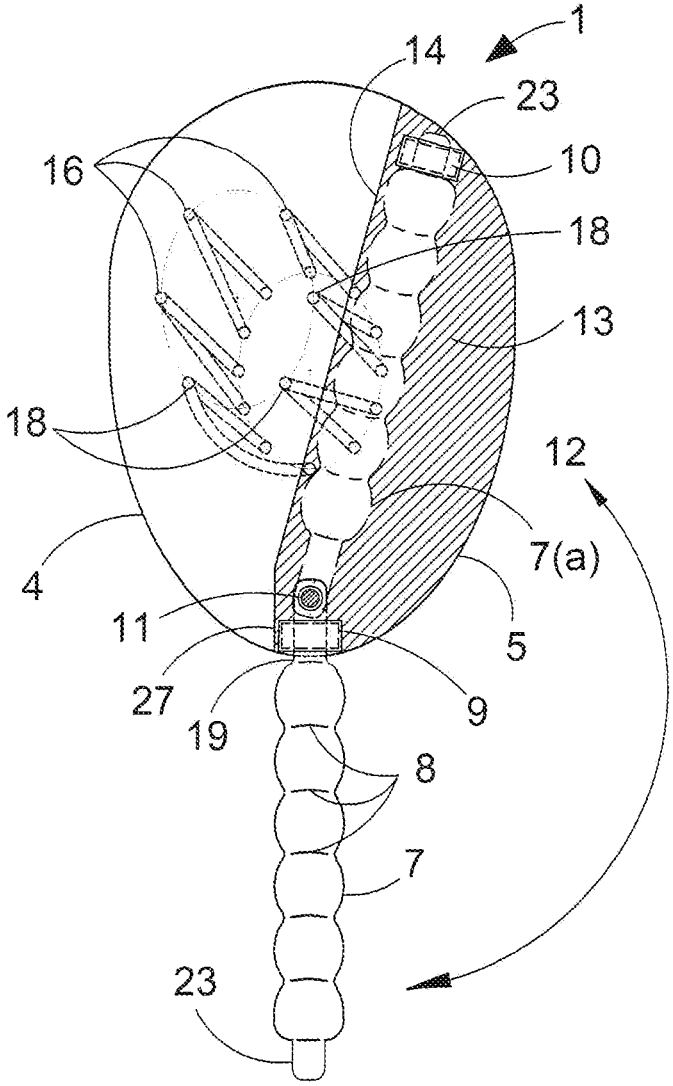

Next, viewing FIG. 4, there is shown a cross-sectional view of the brush 1 as would be seen from section line 4-4 of FIG. 1. Displayed is a stylized, simulated view of the handle 7 as it is stowed within the confines of the compartment 13. The handle 7 may be retracted into the compartment 13 of the brush 1 by rotation in the direction of travel 12 shown. The transverse pin 11 affixed within the lower section of the compartment 13 allows rotation the handle 7 in and out of the compartment 13. An elastomeric securing second clip 10 of a slightly smaller diameter than that of the handle 7, is pried apart by a light pressing force exerted by the user on the handle 7, the retracting stub 23, and the clip 10, thereby receiving the handle 7 into a secure position.

Cross-sections of the gel storage tubes 16 and the moisturizer storage tubes 18 are also shown in FIG. 4. FIG. 4(*a*) illustrates a three-dimensional view of the second clip 10 relative to its orientation and attachment to the compartment wall 14.

Figure 5:
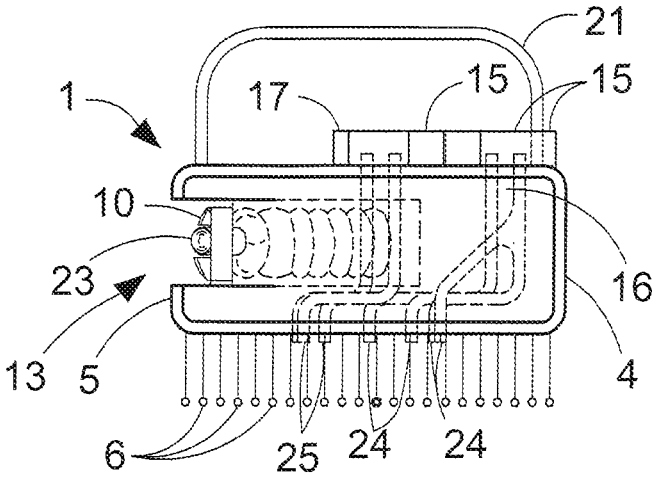
FIG. 5 is a cutaway view, looking downward toward the top end of the brush, as seen from the section line 5-5 of FIG. 1.

FIG. 5 presents a cutaway view of the brush 1 as seen from section line 5-5 of FIG. 1. The brush 1 is observed from the top section looking downward, and further displays a hand strap 21. Displayed are the gel storage packs 15 and their associated tubes 16 extending between the back surface 3 and the front surface 2 of the brush 1. Soap gel dispensing ports 24 and moisturizer dispensing ports 25 are shown projecting from the surface of the brush 1 among the bristles 6. A portion of the storage compartment 13 is also depicted, with the retainer stub 23 nestled within the second clip 10 when the handle 7 is moved to its stowed position.

In its commercial embodiment, the soap gel and moisturizer contained in the storage packs 15, 17 brush 1 will be available in a variety of consumer-selectable fragrances.

While preferred embodiments of the present inventive concept have been shown and disclosed herein, it will be obvious to those persons skilled in the art that such embodiments are presented by way of example only and not as a limitation to the scope of the inventive concept. Numerous variations, changes, and substitutions may occur or be suggested to those skilled in the art without departing from the intent, scope, and totality of the inventive concept. Such variations, changes, and substitutions may involve other features which are already known per se and which may be used instead of or in addition to features already disclosed herein. Accordingly, it is intended that this inventive concept not be limited by the scope of the accompanying claims, but be construed within the scope of the disclosures herein set forth.

What is claimed is:

1. A one-use, disposable shower brush comprising a front surface having bristles embedded therein, a top end, a lower end, a back surface, a right side, an open left side;

a rotatable handle having a lower end a with cylindrically-shaped retainer stub extending from the lower end of said handle and an upper end having a cylindrically-shaped hilt extending from said upper end, said hilt having a circular slot or aperture therethrough;

a compartment between the front surface and back surface of said brush, said compartment having an opening on the left side of said brush, and further, said compartment having dimensions sufficient to accommodate said rotatable handle in a retracted position;

a cylindrical pin having a diameter corresponding to the diameter of said circular slot, said pin being inserted through said circular slot with a corresponding frictional tightness, said pin further having one end orthogonally embedded in the inner portion of the front surface of said brush and the opposite end embedded in the inner portion of the back surface of said brush; whereby said handle is rotatable about said pin, from an extended position at the lower end of said brush to a retracted position within the compartment of said brush;

at least one storage container for a liquid soap gel, at least one storage container for a liquid moisturizer, at least one passageway leading from said at least one soap gel storage container to at least one soap gel discharge port in the front surface of said brush, and at least one passageway leading from said at least one moisturizer storage container to at least one moisturizer discharge port in the front surface of said brush;

a means for discharging either said soap gel or said liquid moisturizer into their respective passageways;

a first clip constructed of a semi-rigid or elastomeric material having a semi-circular opening integral to a rectangular base, said base being affixed to the lower inner wall of the back surface of said brush, said opening of a smaller diameter than the diameter of the hilt of the handle;

a second clip constructed of a semi-rigid or elastomeric material having a semi-circular opening integral to a rectangular base, said base being affixed to the upper inner wall of the back surface of the brush, further, said opening of a smaller diameter than the diameter of the retainer stub of the handle; whereby, the handle may be firmly secured in either a retracted or an extended position.

2. A disposable, one-use shower brush as in claim 1, wherein the means for discharging either said soap gel or said liquid moisturizer into their respective passageways comprises storage containers constructed of a flexible or elastomeric material, said storage containers being thereby compressible by pressure exerted by the fingers of a user.

* * * * *